US008833846B2

(12) United States Patent
Lucas

(10) Patent No.: US 8,833,846 B2
(45) Date of Patent: Sep. 16, 2014

(54) SEAT

(75) Inventor: James Lucas, London (GB)

(73) Assignee: Spliced IP Ltd., London (GB)

( * ) Notice: Subject to any disclaimer, the term of this patent is extended or adjusted under 35 U.S.C. 154(b) by 77 days.

(21) Appl. No.: 13/806,786

(22) PCT Filed: Jul. 1, 2011

(86) PCT No.: PCT/GB2011/051255
§ 371 (c)(1),
(2), (4) Date: Dec. 24, 2012

(87) PCT Pub. No.: WO2012/001429
PCT Pub. Date: Jan. 5, 2012

(65) Prior Publication Data

US 2013/0099540 A1 Apr. 25, 2013

(30) Foreign Application Priority Data

Jul. 1, 2010 (GB) ..... 1011059.1

(51) Int. Cl.

| | |
|---|---|
| ***A47C 13/00*** | (2006.01) |
| ***A47C 17/04*** | (2006.01) |
| ***A47C 1/00*** | (2006.01) |
| ***A47C 7/40*** | (2006.01) |
| ***A47C 3/20*** | (2006.01) |
| ***A47C 31/12*** | (2006.01) |
| ***A47C 4/52*** | (2006.01) |

(52) U.S. Cl.
CPC . *A47C 3/20* (2013.01); *A47C 7/402* (2013.01); *A47C 31/126* (2013.01); *A47C 4/52* (2013.01)
USPC ..... 297/105; 297/340

(58) Field of Classification Search
USPC ..... 297/307, 309, 338, 339, 340, 105, 297/300.1
See application file for complete search history.

(56) References Cited

U.S. PATENT DOCUMENTS

| | | | | |
|---|---|---|---|---|
| 7,073,860 | B2 * | 7/2006 | Markus | 297/340 X |
| 7,401,858 | B2 * | 7/2008 | Lee | 297/340 X |
| 7,735,926 | B1 * | 6/2010 | Combs | 297/339 |
| 2012/0025574 | A1 * | 2/2012 | Wilkinson et al. | 297/300.1 |

* cited by examiner

*Primary Examiner* — Rodney B White

(57) ABSTRACT

A seat comprises a seat squab (12), a supporting structure (15) and a backrest (14), in use, the seat squab (12) being movable in a substantially downward direction relative to the supporting structure when weight is applied to the seat squab (12), and the substantially downward movement of the seat squab (12) causing automatic movement of the backrest (14) in a substantially upward direction, the angular orientation of an upper surface of the seat squab (12) relative to the supporting structure remaining unchanged during the substantially downward movement of the seat squab.

20 Claims, 9 Drawing Sheets

SEAT

BACKGROUND TO THE INVENTION

It is well known to provide an adjustable seat for use in a domestic or commercial environment in which the seat squab can be adjusted to a particular inclination or height. Furthermore, it is also known to provide backrest adjustment, for example, tilting of the backrest. However, these features are all directed to the ergonomic design of a chair, and particularly to the comfort of different shapes of a person sat in the chair.

These adjustments do not address the problems of how a seat fits into or tessellates with an environment when it is not occupied by a user, for example, when stowed adjacent a table, desk or other work surface. Furthermore, they do not address the problems involved in improving comfort when in the process of sitting in or rising from a chair. They also do not address the problems of seat functionality, in the sense of utilising a single design of chair or seat to provide different types of seating for different environments.

It is an object of the invention to provide an improved seat which reduces or obviates the aforementioned problems.

SUMMARY OF THE INVENTION

According to the present invention, there is provided a seat comprising a seat squab, a supporting structure and a backrest, in use, the seat squab being movable in a substantially downward direction relative to the supporting structure when weight is applied to the seat squab, and the substantially downward movement of the seat squab causing automatic movement of the backrest in a substantially upward direction, the angular orientation of an upper surface of the seat squab relative to the supporting structure remaining unchanged during the substantially downward movement of the seat squab.

The seat is advantageous because the seat squab is movable downwards to the final sitting position. In other words, the seat supports a user from a higher position during sitting than other seats and moves downwardly whilst supporting the user to some extent as it moves downwardly.

Additionally, the user is reassured that the seat squab will always be in a suitable position for sitting on and use of the seat is immediately intuitive.

The angular orientation of an upper surface of the seat squab relative to a back support surface of the backrest may remain substantially unchanged during the substantially downward movement of the seat squab.

The seat squab and backrest may be adapted to move between a first position in which an upper edge of the backrest lies substantially at the same height as the seat squab and a second position in which the backrest extends above the height of the seat squab.

Advantageously, the seat can be easily stowed under tables, desks, work surfaces and the like. This has the benefit of reducing clutter and trip hazards in an environment. Furthermore, the seat can be positioned adjacent or attached to other similar seats to form a long bench seat that can be stepped over to gain access to a bench table, as with traditional bench seats. However, once seated, such a beach seat offers each user their own personal backrest.

A further advantage is that a user can approach the seat from the rear, straddle it with their legs on either side of the seat when first sitting on it, for example, to gain access to a table, for example, as with a stool. Once seated, the backrest automatically erects.

A yet further advantage is that the seat height at rest is typically around 15% higher that a standard seat height. This gives less distance for a user to travel to get on to the seat, and once there smoothly descends the user to the final seated height. This aids people with restricted movement.

The seat also offers the benefits of both a chair and a stool, and a transition between the two states takes place without any external power or operation from the user (other than them sitting down).

The supporting structure may include arm rests, the backrest being adapted to move between a first position in which an upper edge of the backrest lies substantially at the same height as the arm rests and a second position in which the backrest extends above the height of the arm rests.

The seat squab may be positioned below the height of the armrests in the first position.

A linkage may multiply the movement of the seat squab, the movement of the seat squab causing a greater movement of the backrest. The seat may be arranged such that upward movement of the backrest is amplified relative to the downward movement of the seat squab, for example, by a ratio of 4:1. In other words, the backrest travels upwardly four times the distance travelled by the seat squab.

A lock may be provided for locking the position of the seat squab and backrest relative to the supporting structure.

The seat squab may be biased upwardly, for example, by means of a gas spring.

The seat squab may be mounted to a carriage, which may be movable relative to the supporting structure.

Guide members may guide the movement of the carriage relative to the supporting structure.

The backrest may be movable relative to the carriage and guide members may be mounted within the carriage for guiding movement of the backrest.

A trolley may be mounted to the backrest and may travel along the guide members, in use. At least one drive member may be pivotally connected to the carriage, may extend over a pivot point of the supporting structure and may connect with and drive the trolley.

In an alternative embodiment, the guide members may be mounted within the arm rests for guiding movement of the backrest. Guide rollers and a backrest support plate may travel along each of the guide members, in use.

It is also envisaged that the seat can be provided on castors for ease of movement. It can also be provided on a swivel arrangement. As with conventional seats, the seat squab and backrest may also be independently adjustable relative to the carriage, to provide the ergonomic adjustments required for individual comfort. These adjustments to do not affect the operation of the seat.

It is envisaged that the linkage between the seat squab and backrest may be provided by different arrangements, for example, hydraulic, pneumatic, electrical or an alternative mechanical arrangement of gears and pulleys.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF PREFERRED EMBODIMENTS

Figure 1:
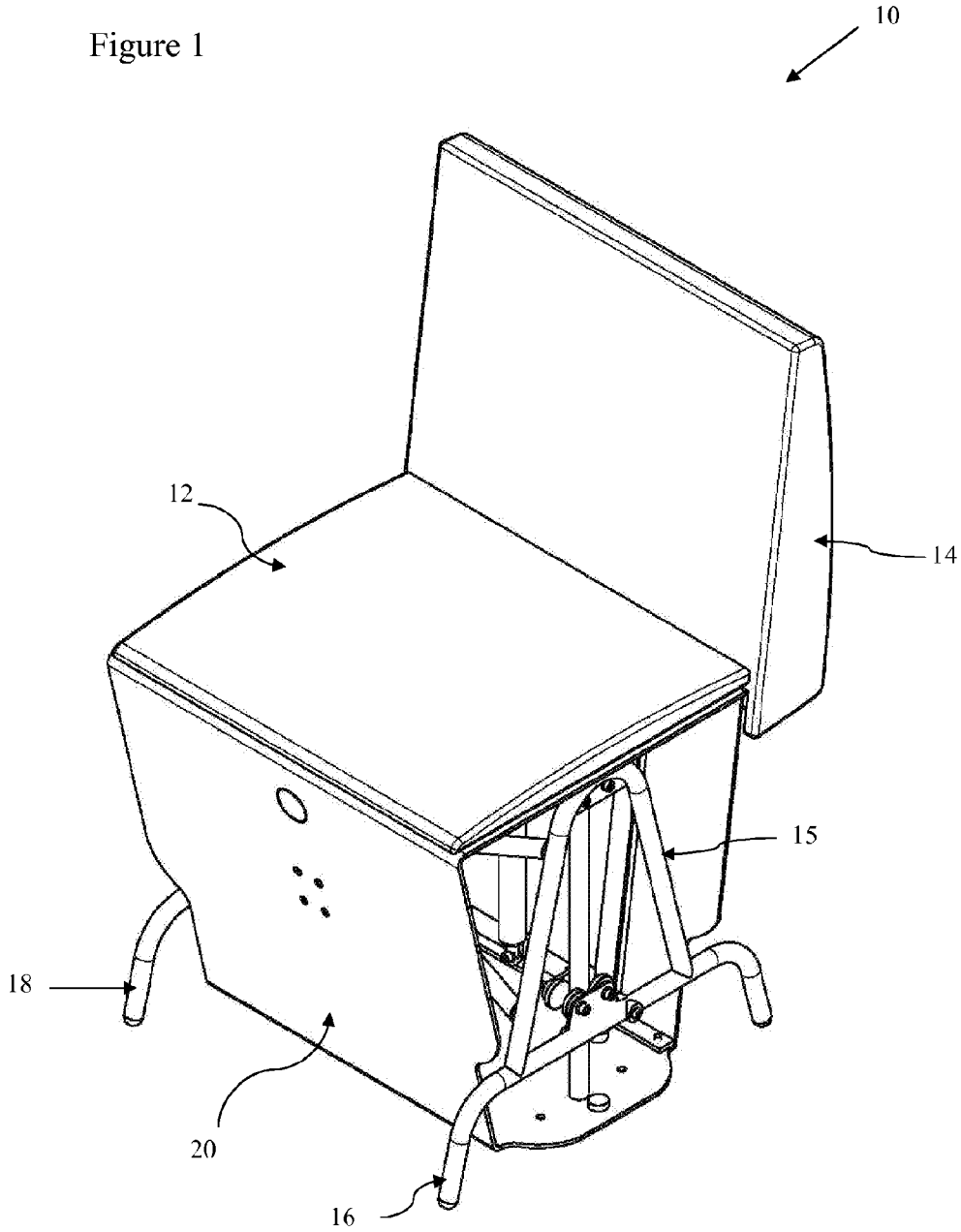
FIG. 1 shows a schematic perspective side view of a first embodiment of a seat, with the side panels of the base removed and the seat in an operative or open position.
Figure 2:
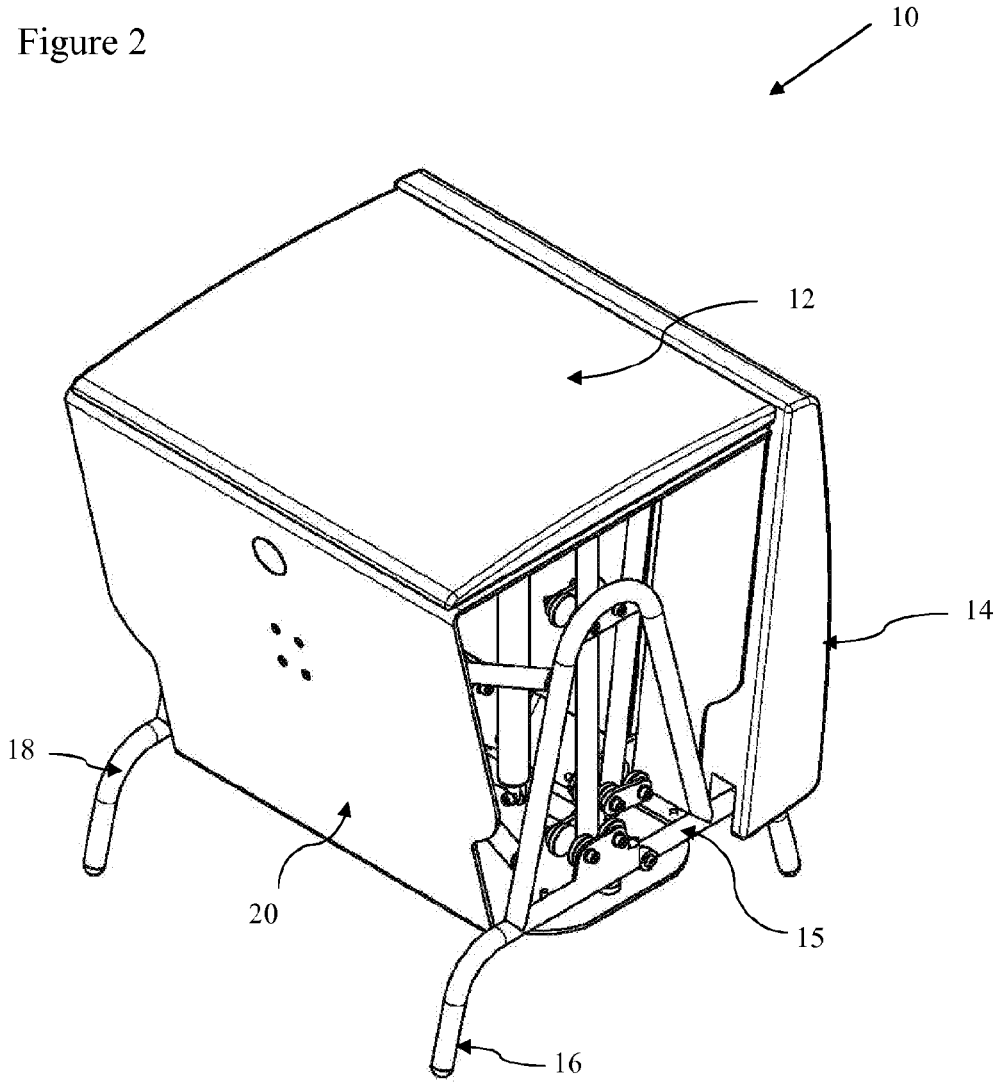
FIG. 2 shows a schematic perspective side view of the seat of FIG. 1, with the seat in an inoperative position.

Referring to FIGS. 1 and 2, a first embodiment of a seat is indicated generally at 10. The seat 10 includes a seat squab 12, a backrest 14, a supporting structure 15 including first and second side structures 16, 18 and a carriage 20, mounted between the first and second side structures 16, 18. The carriage 20 substantially houses a mechanism, indicated generally at 22 in FIG. 5, which allows the squab 12 to move substantially downwardly relative to the supporting structure 16, 18 and drives the backrest 14 substantially vertically upwards when the squab moves downwardly.

Figure 3:
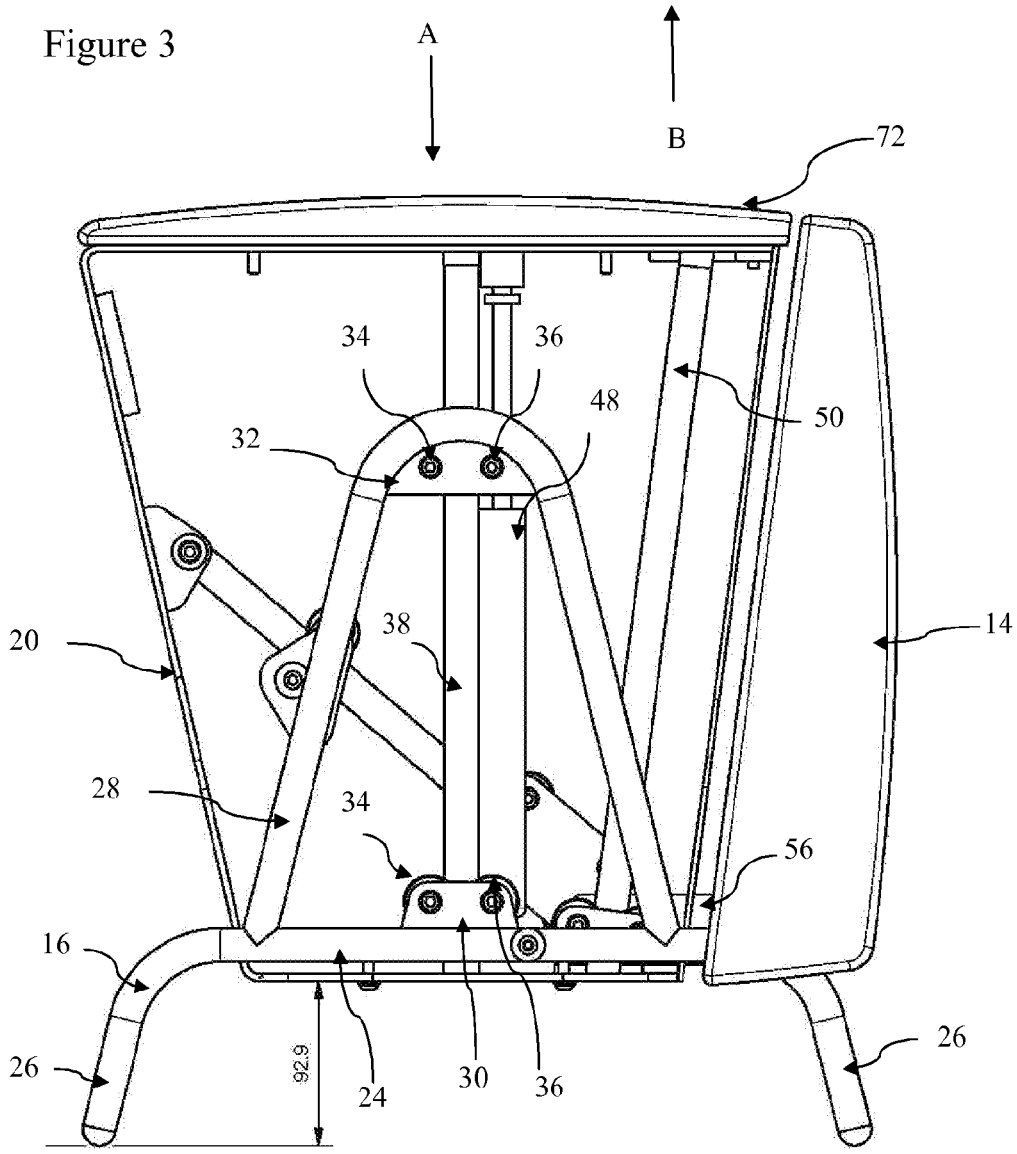
FIG. 3 shows a side view of the seat of FIG. 1 in the inoperative or closed position.
Figure 4:
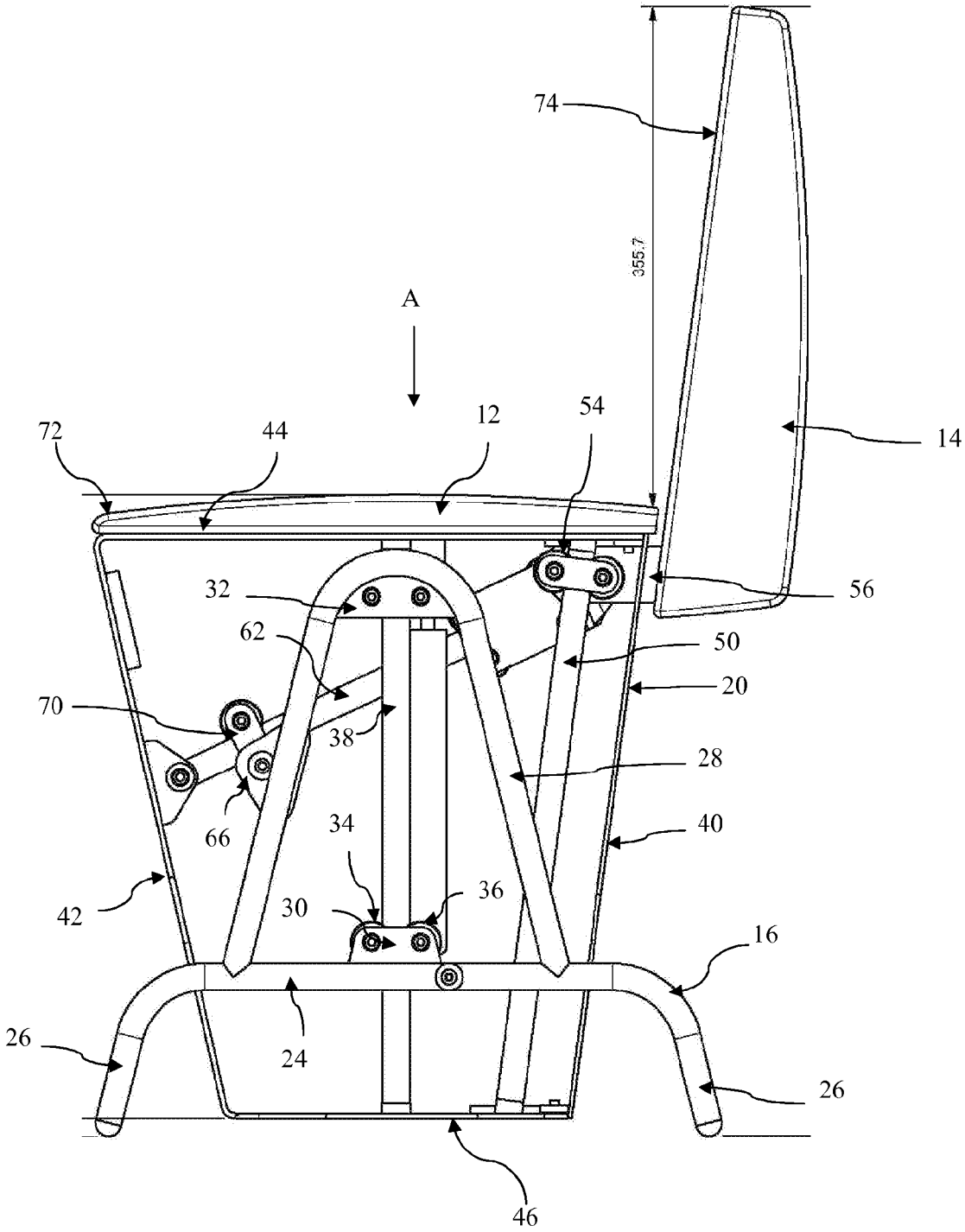
FIG. 4 shows a side view of the seat of FIG. 1 in the operative or open position.

Referring in particular to FIGS. 3 and 4, each side structure 16, 18 of the supporting structure includes a horizontal member 24 supported spaced from the ground by legs 26 at either end thereof An inverted substantially "V-shaped" member 28 is mounted on and extends upwardly from the horizontal member 24. Support plates 30, 32 arc mounted to the horizontal member 24 and the upper end of the inverted V-shaped member 28 respectively. A pair of concave rollers 34, 36 is mounted to the inside of each support plate 30, 32. The rollers 34, 36 rotate about bearings. A substantially vertically disposed tubular guide member 38 is guided between the rollers and can move freely upwards and downwards between the rollers 34, 36, shown also in FIGS. 5 and 6. The side structures are connected together, inter alia, by a horizontally disposed connecting member 31, attached to the insides of each of the horizontal members 24, to the rear side of the mounting plates 30.

The carriage 20 has a rear wall 40, a front wall 42, an upper wall 44 and a lower wall 46. The front and rear walls 42, 40 slope inwardly from top to bottom, such that the shape of the side of the carriage is trapezoidal. Each tubular member 38 is mounted to the carriage 20 and is attached at either end to the upper and lower walls 44, 46 respectively. The seat squab 12 is attached to the upper surface of the upper wall 44. In this way the carriage 20 and seat squab 12 can both move freely upwardly and downwardly on the supporting structure 15. A gas spring, known also as a gas strut 48, is provided for controlling the movement of the carriage 20 relative to the supporting structure. One end of the gas strut is mounted to the connecting member 31 and the other end is connected to the underside of the upper wall 44 of the carriage 20. When the carriage 20 is pushed downwardly relative to the supporting structure, then the gas strut is compressed, but when load is removed from the carriage, the gas strut extends and pushes the carriage upwardly, as explained further below.

Figure 6:
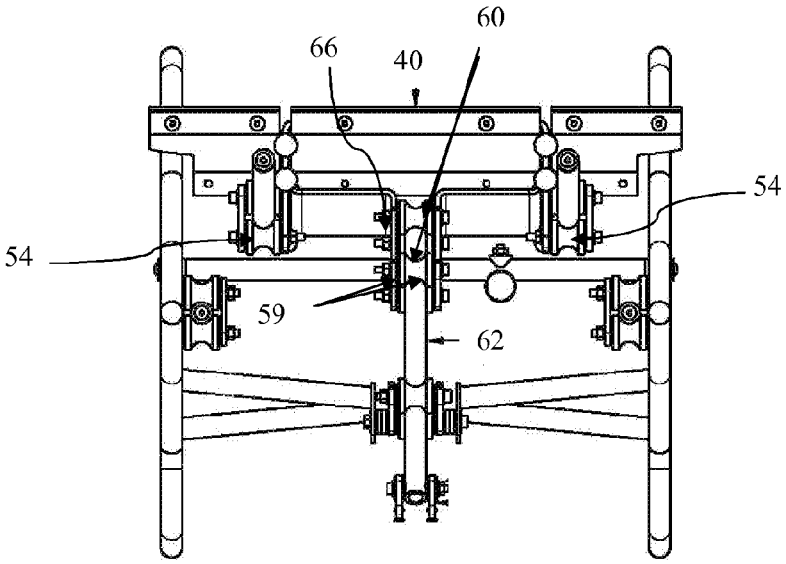
FIG. 6 shows a plan view from above of the mechanism of the seat of FIG. 1 in the inoperative or closed position.
Figure 7:
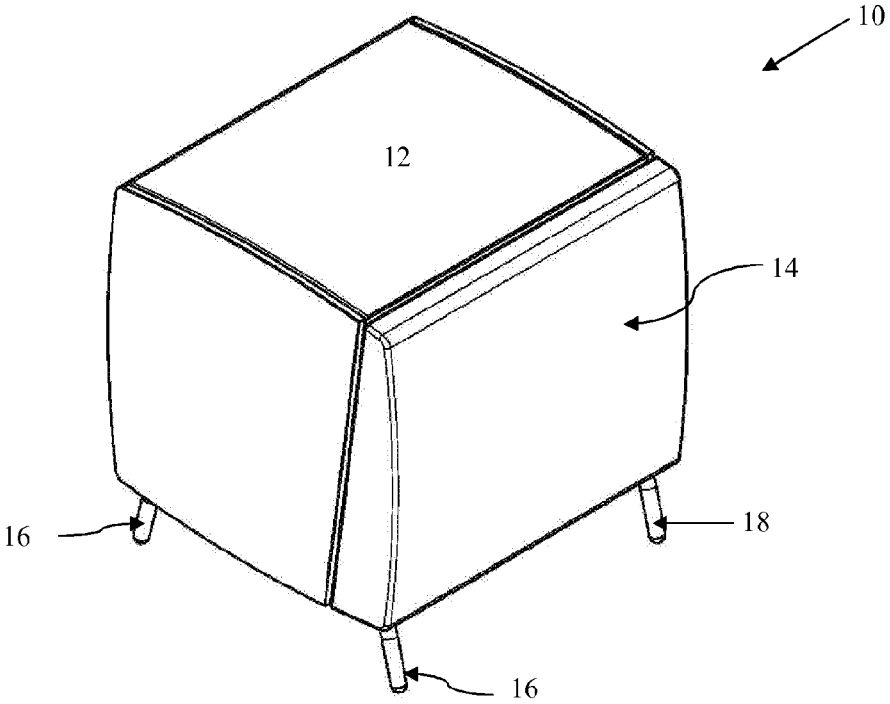
FIG. 7 shows a schematic perspective view from the rear of the seat of FIG. 1 in the inoperative position, with the side panels in place.

A pair of guide members 50 are mounted within the carriage 20 parallel with rear wall 40, that is, inclined at an angle of around 10 degrees to the vertical. The guide members 50 are spaced apart and are connected to the upper and lower walls 44, 46 of the carriage 20 at their ends. A trolley 52 is mounted for sliding movement along the guide members 50, and is attached to the backrest 14 for guiding the upward and downward movement of the backrest 14. Two sets of concave guide rollers 54 are provided, one set on each side of the trolley, as best seen in FIG. 6, which rotate on and are guided by the guide members 50. Each set of guide rollers 54 includes two rollers, mounted on either side of the guide member 50. Structural plates 56 of the trolley extend through slots 58 in the rear wall 40 of the carriage 20 and arc connected to the backrest 14, as best seen in FIG. 3. The guide rollers 54 are mounted to the outside edges of the plates 56.

Figure 5:
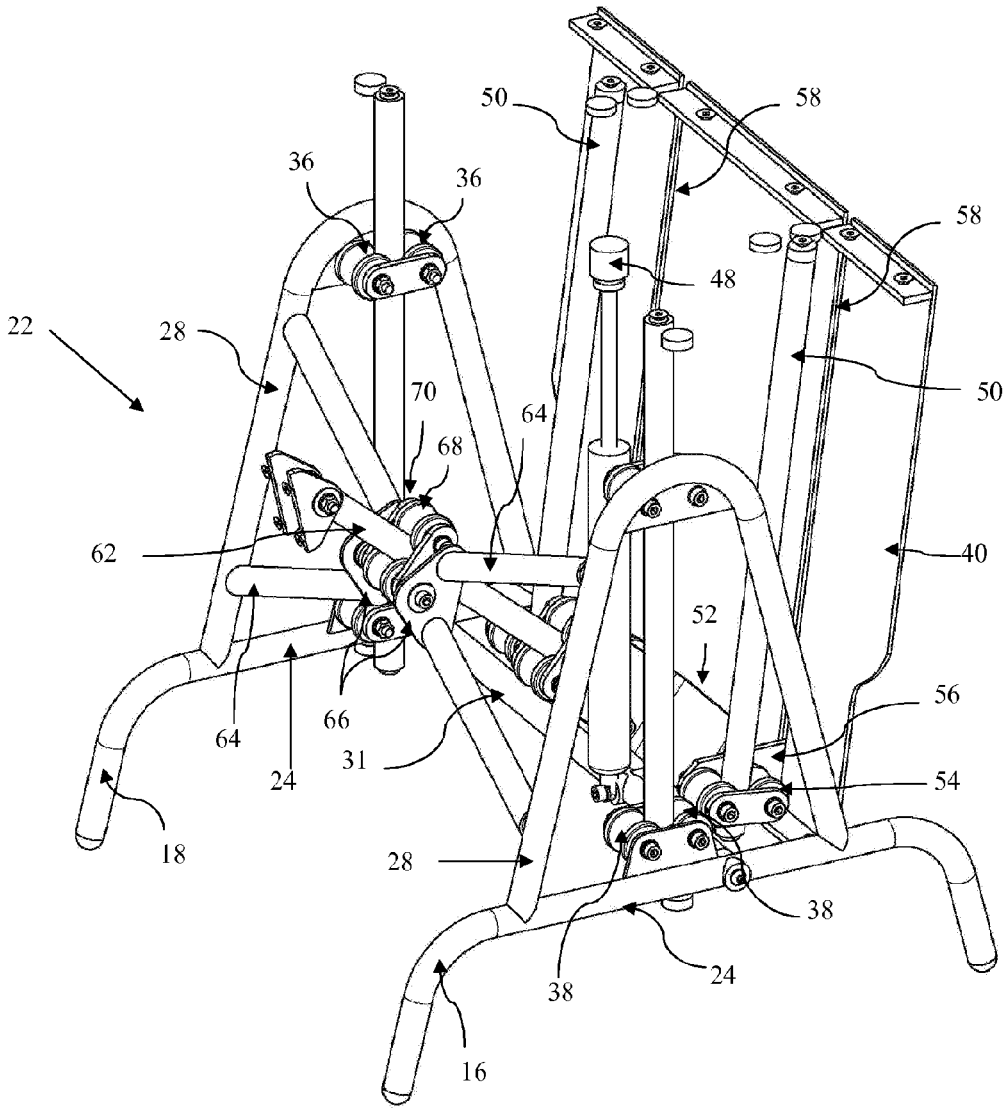
FIG. 5 shows a schematic perspective view of the mechanism of the seat of FIG. 1 in the inoperative or closed position.

A central part of the trolley 52 is mounted to, and is journalled to the inside edges of the plates 56, thereby allowing the central part of the trolley to rotate, as explained further below. Two spaced and parallel disposed support plates 59 form the central region of the trolley and the plates 59 are connected together and support two pairs of concave rollers 60. The pairs of rollers are positioned one behind the other for receiving and supporting a drive member 62. Referring in particular to FIG. 5, a cross-shaped support structure 64 is mounted between the inverted V-shaped members 28 of the side structures 16,18, to the front of the seat 10. Two spaced and parallel disposed support plates 66 are mounted at the centre of the cross-shaped support structure 64. A pair of concave guide rollers 68 is rotatably mounted between two smaller plates 70, and are themselves pivotally mounted to the support plates 66. The rollers 68 provide a central support and pivot point for the drive member 62.

One end of the drive member 62 is pivotally mounted to the front wall 42 of the carriage 20, substantially at its centre. The drive member 62 then extends through the pair of concave rollers 68, themselves pivotally mounted to the cross-shaped support structure 64. The other end of the drive member extends between the two pairs of rollers 60 of the trolley 52.

In use, the rest position of the seat 10 is as shown in FIGS. 2,3,5 and 7. The gas strut 48 is in the extended position and the carriage 20 is fully raised on the supporting structure 15. The backrest 14 is substantially the same width and height as the carriage 20 and seat squab 12 and lies behind the rear wall 40 of the carriage 20. The upper edge of the backrest is substantially at the same height as the upper surface of the seat squab. In this position the trolley 52 is at the lower end of its movement on the guide members 50. The drive member 62 is angled downwards from the pivotal connection to the front wall 42 of the carriage 20, through the rollers 68 and into the two pairs of rollers 60 of the trolley 52. It will be appreciated that the rollers 68 and 60 align themselves with the drive member 62 according to its position.

When a downward force is applied to the seat squab 12, for example by a person sitting on the scat, as indicated by arrow A, the carriage and scat squab move downwardly against the upward resistance of the gas strut 48. The carriage 20 and seat squab 12 move substantially vertically downwards as guided by the guide members 38. The angular orientation of an upper surface 72 of the seat squab 12 relative to the supporting structure 15 remains substantially unchanged during the aforementioned movement. As the carriage moves downwards, the end of the drive member 62 pivotally attached to the front wall of the carriage also moves downwards and the drive member is forced to pivot as it bears against the rollers 68. The other end of the drive member 62 is forced upwardly, in the manner of a lever, and in turn forces the trolley 52 upwardly on the guide members 50. The backrest 14 moves upwardly with the trolley 52, as indicated by arrow B, and its orientation to the back of the carriage 20 is unchanged because the guide members 50 are substantially parallel with the rear wall 40 of the carriage. Furthermore, the angular orientation of the upper surface of the 72 seat squab 12 relative to a back support surface 74 of the backrest 14 also remains unchanged during the downward movement of the seat squab and the simultaneous upward movement of the backrest. The back support surface 74 of the backrest 14 supports a user's back when the seat 10 is in the operative position. During the movement, the central portion of the trolley rotates on the plates 56 and the two pairs of rollers 60 self-align with the drive member 62 as it changes angular position relative to the trolley. The length of the drive member 62 is such that it is long enough to be continuously engaged in the trolley 52 throughout the movement, but short enough to not catch the rear wall 40 of the carriage during the movement.

When the carriage 20 reaches a position just above the floor, say around 12.5 mm above the floor, the movement is complete and the seat is in an operative or open position as shown in FIGS. 1 and 4, with the majority of the backrest 14 positioned above the seat squab 12, for example, with around 355 mm of backrest extending above the seat squab for a seat of around 455 mm height. In this position the trolley 52 is positioned adjacent the underside of the upper wall 44 of the carriage 20. To return the movement, the weight is simply removed from the seat, for example, by the person standing up, and the gas strut pushes the carriage upwardly, thus causing the drive member 62 to lever or force the backrest downwardly. The weight of the backrest 14 assists the movement. The gas strut 48 has a damping effect and smoothes out any jolts in the movements and also controls the speed of the movements. Optionally a lock is provided for locking the position of the backrest relative to the scat squab 12, for example, by locking the carriage to the supporting structure. In one embodiment, the gas strut may be lockable, for example, by means of a button, lever or switch on the front of the seat.

In an alternative arrangement of the first embodiment of the seat 10, the supporting side structures may be made from solid panels to provide a different aesthetic.

In a yet further alternative embodiment, the supporting side structures may be replaced by vertically disposed support pillars, which extend within the or outside the carriage. The gas strut may be contained within one of the pillars, if desired.

Figures 8A, 8B, 8C:
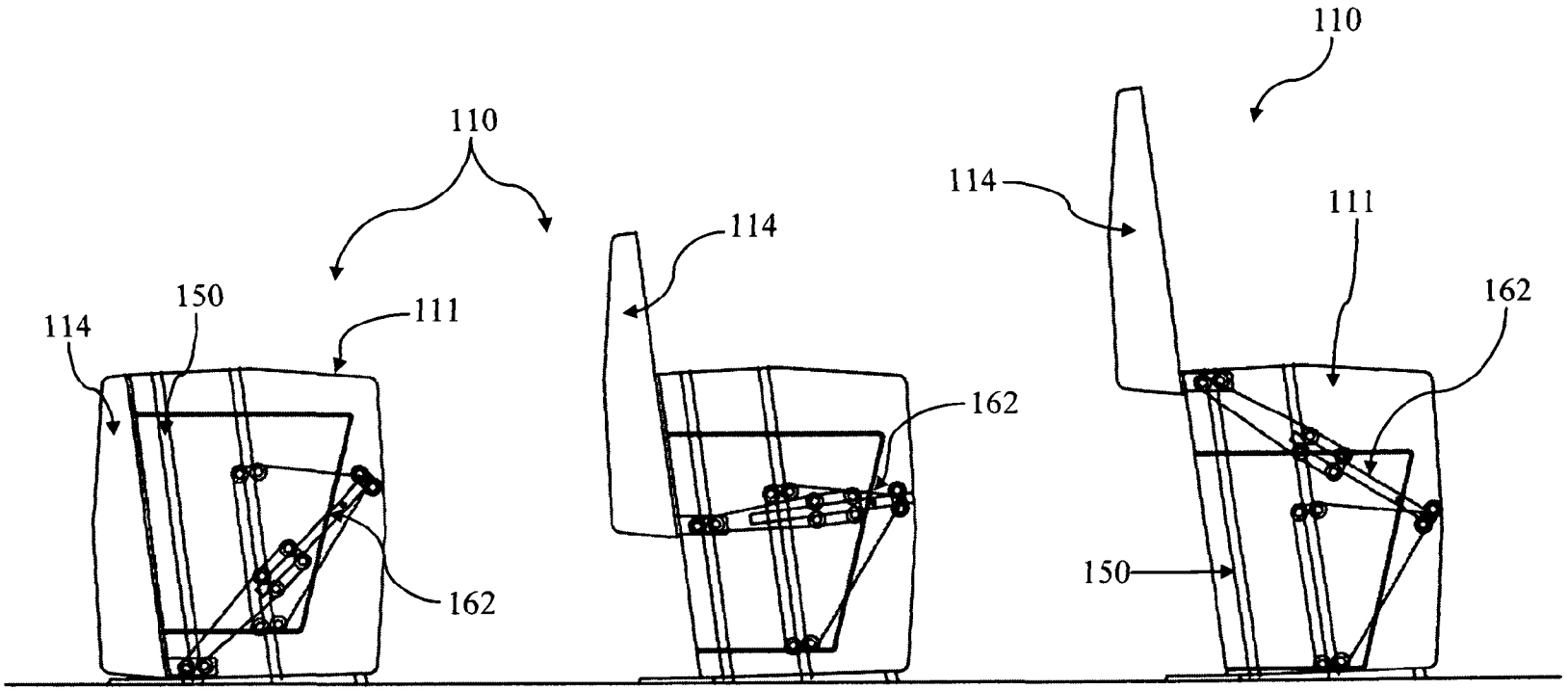
FIG. 8A shows a schematic side view of a second embodiment of a seat in a first or closed position, showing the internal mechanism excluding the gas spring.
FIG. 8B shows the seat of FIG. 8A in a part opened position.
FIG. 8C shows the seat of FIG. 8A is a second or fully opened position.
Figures 9A, 9B, 9C:
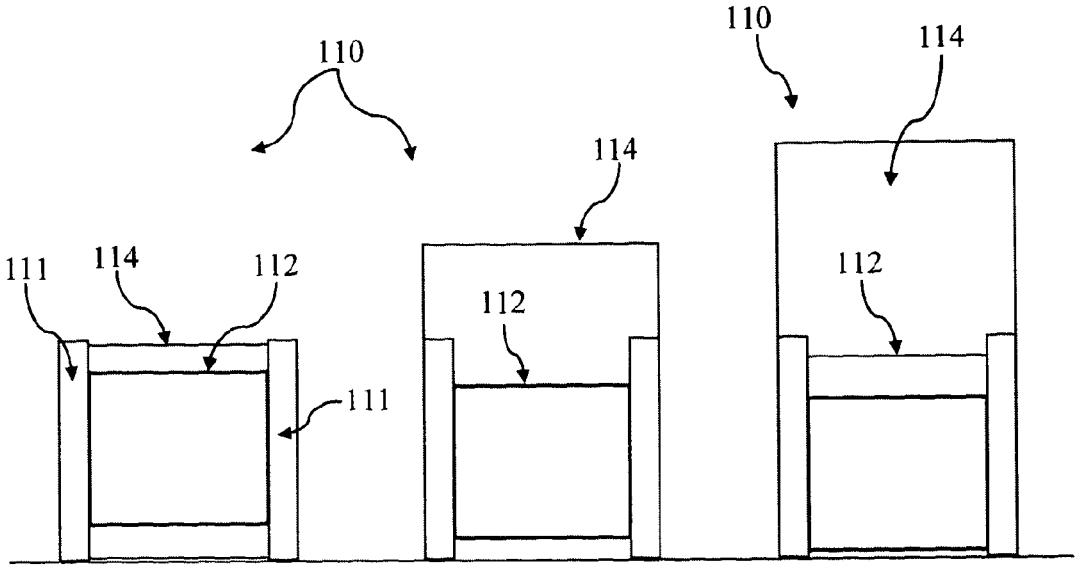
FIG. 9A shows a front view of the seat of FIG. 8A in a first or closed position.
FIG. 9B shows a front view of the seat of FIG. 8A in a part opened position.
FIG. 9C shows a front view of the seat of FIG. 8A in a second or fully opened position.

A further embodiment of the seat is indicated at 110 in FIGS. 8A to 9C. The operation of the seat 110 is similar to that of the first embodiment of seat 10, in that downward pressure on the seat squab 112 causes automatic upward movement of the backrest 114. However, the seat 110 includes fixed armrests 111 on either side of the seat squab 112, which are higher than the seat squab in the closed position, as shown in FIGS. 8A and 9A. The armrests form the supporting structure. Furthermore, the top of the backrest 114 lies at the same height as the top of the armrests 111, when the seat is in the closed position. The mechanism for movement of the backrest 112 is located in the two armrests and guide members 150 are located in the armrests 111. There are also two drive members 162 located within the armrests, rather than a single central drive member. Otherwise, the components are similar. The advantage of the second embodiment is that the extra height gained by using armrests, for example, around 150 mm, means that the backrest can travel further, thus offering a greater amount of back support for a user. The first embodiment has the advantage that the upper surface of the seat is substantially all at the same height in the closed position.

Figure 10:
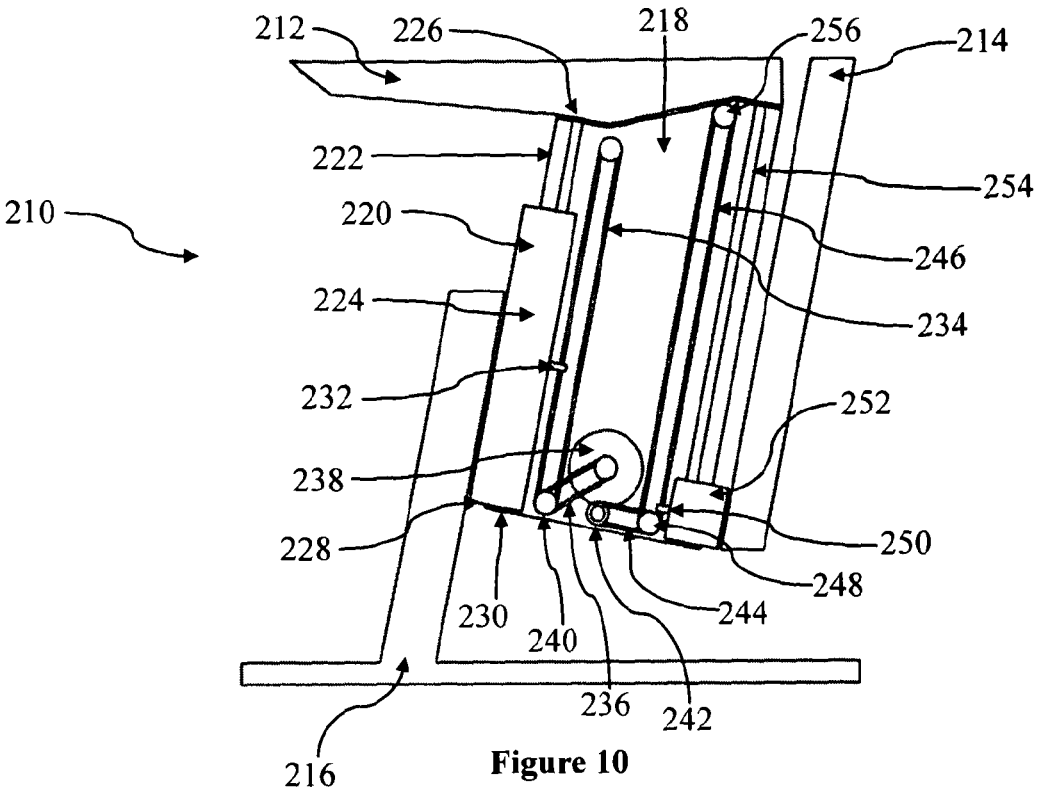
FIG. 10 shows a schematic perspective side view of a third embodiment of a seat with the side panels of the carriage removed, and the seat being in the inoperative or closed position.
Figure 11:
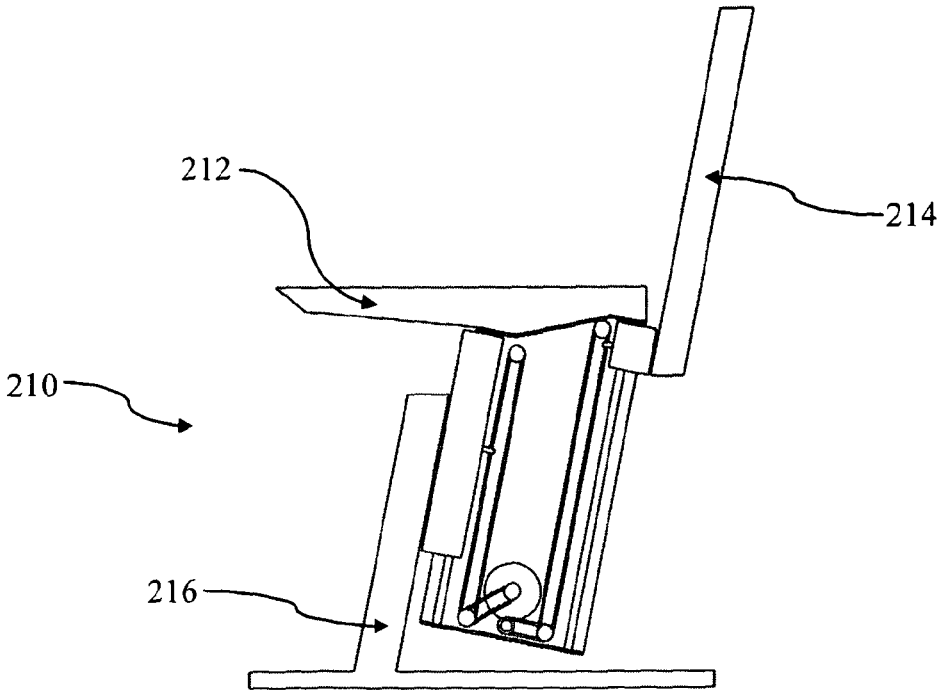
FIG. 11 shows a side view of the seat of FIG. 10 in the operative or open position.

A yet further embodiment of the seat is indicated at 210 in FIGS. 10 and 11. The seat includes a seat squab 212, a backrest 214, a supporting structure provided in the form of a stem and base unit 216, and a carriage 218 which contains the movement mechanism. The carriage 218 is mounted to the stem and base unit 216.

The carriage 218 houses a biasing unit 220 which is oriented offset from the vertical by around 10°. The biasing unit 220 comprises an elongate slider portion 222 and a body portion 224, the elongate slider portion being slidably received within the body portion 224. One end 226 of the slider portion 222 is connected to an under surface of the seat squab 212 and the other end 228 of the slider portion 222 is connected to a lower wall 230 of the carriage 218. The biasing unit 220 biases the seat squab 212 into the upper, inoperative position, as shown in FIG. 10.

The body portion 224 of the biasing unit 220 is aligned with and connected to the stem and base unit 216. A slide to belt fixing 232, i.e. a connection from the slider portion 222 to a first toothed drive belt 234, is provided on an opposing side of the body portion 224 to the stem and brace unit 216. The first and a second toothed drive belt 234, 236 link the slider portion 222 to a first step up gear cog 238 via a toothed pulley 240. The first step up gear cog 238 is engaged with a second step up gear cog 242, which drives third and fourth toothed drive belts 244, 246 via a further toothed pulley 248. The fourth toothed drive belt 246 is connected to a further slide to belt fixing 250, which in turn is connected to a slider unit 252 that is slidable about a linear guide 254. One end 256 of the linear guide 254 is connected to the under surface of the seat squab 212 and the other end 258 of the linear guide 254 is connected to the lower wall 230 of the carriage 218. The linear guide 254 is in parallel with the slider portion 222 of the biasing unit 220. The back rest 214 is adjacent to and in spaced parallel relationship with the linear guide 254 and is driven up and down along the linear guide 254 by the slider unit 252.

The seat 210 operates in a similar way to the previous embodiments with a key difference being that the relative movement between the seat squab and the backrest is possible due to the toothed drive belts 234, 236, 244, 246 and the two toothed pulleys 240, 248. Vertical movement of the backrest 214 is limited by the slider unit 252 abutting the under surface of the seat squab 212 in use.

As with the previous embodiments, it is important to note that the angle of the seat squab 212 relative to the horizontal, or more specifically to the stem and base unit 216, is the same whether the seat 210 is in the open or the closed positions.

The scat 10, 110, 210 is adaptable and multi-functional because it can be locked in the closed or inoperative position and used as a stool, or can be locked in the open or operative position and used as a chair. Also, when left unlocked, the backrest automatically rises for use when a user sits down and returns to the closed, stool like position, when the user gets up. When used as explained above, it has the benefit of being able to be used as a chair, without the visual impact of a chair being constantly in the room. The width of the seat can be made to suit any domestic or commercial environment, for example, for one, two or three people. Furthermore, the chair can be used as a novelty item, for example, in reception areas, and can provide advantages of size and stowability in dining halls and living spaces.

The invention claimed is:

1. A seat comprising a seat squab, a supporting structure and a backrest, in use, the seat squab being movable in a substantially downward direction relative to the supporting structure when weight is applied to the seat squab, and the substantially downward movement of the seat squab causing automatic movement of the backrest in a substantially upward direction, the angular orientation of an upper surface of the seat squab relative to the supporting structure remaining unchanged during the substantially downward movement of the seat squab.

2. A seat as claimed in claim 1, in which the angular orientation of the upper surface of the seat squab relative to a back support surface of the backrest remains substantially unchanged during the substantially downward movement of the seat squab.

3. A seat as claimed in claim 1, in which the seat squab and backrest are adapted to move between a first position in which an upper edge of the backrest lies substantially at the same height as the seat squab and a second position in which the backrest extends above the height of the seat squab.

4. A seat as claimed in claim 3, in which the seat squab is biased upwardly to the first position, when not in use.

5. A seat as claimed in claim 1, in which the supporting structure includes arm rests, the backrest being adapted to move between a first position in which an upper edge of the backrest lies substantially at the same height as the arm rests and a second position in which the backrest extends above the height of the arm rests.

6. A seat as claimed in claim 5, in which the seat squab is positioned below the height of the armrests in the first position.

7. A seat as claimed in claim 1, in which a linkage multiplies the movement of the seat squab, the movement of the seat squab causing a greater movement of the backrest.

8. A seat as claimed in claim 1, in which a lock is provided for locking the position of the seat squab and backrest relative to the supporting structure.

9. A seat as claimed in claim 1, in which the seat squab is biased upwardly.

10. A seat as claimed in claim 9, in which the seat is biased by means of a gas spring.

11. A seat as claimed in claim 1, in which the seat squab is mounted to a carriage, which is movable relative to the supporting structure.

12. A seat as claimed in claim 11, in which guide members guide the movement of the carriage relative to the supporting structure.

13. A seat as claimed in claim 11, in which the backrest is movable relative to the carriage.

14. A seat as claimed in claim 11, in which guide members are mounted within the carriage for guiding movement of the backrest.

15. A seat as claimed in claim 14, in which a trolley is mounted to the backrest and travels up and down the guide members, in use.

16. A seat as claimed in claim 15, in which at least one drive member is pivotally connected to the carriage, extends over a pivot point of the supporting structure and connects with and drives the trolley.

17. A seat as claimed in claim 14, in which the supporting structure includes arm rests, the backrest being adapted to move between a first position in which an upper edge of the backrest lies substantially at the same height as the arm rests and a second position in which the backrest extends above the height of the arm rests, and in which the guide members are mounted within the arm rests for guiding movement of the backrest.

18. A seat as claimed in claim 17, in which guide rollers and a backrest support plate travel up and down each of the guide members, in use.

19. A seat comprising a seat squab, a supporting structure, a backrest and a linkage, in use, the seat squab being movable from a first position in which an upper edge of the backrest lies substantially at the same height as the seat squab and a second position in which the backrest extends above the height of the seat squab, the movement of the seat squab between the first position and the second position being in a substantially downward direction relative to the supporting structure, said movement taking place when weight is applied to the seat squab, the seat squab being biased to the first position, and the seat squab being connected to the backrest via the linkage, the linkage operating to cause automatic movement of the backrest in a substantially upward direction when the seat squab is moved from the first position to the second position, the angular orientation of an upper surface of the seat squab relative to the supporting structure remaining unchanged during the substantially downward movement of the seat squab

20. A seat as claimed in claim 19, in which the linkage multiplies the movement of the seat squab, the movement of the seat squab causing a greater movement of the backrest.

* * * * *